US005250173A

United States Patent [19]

Jozefowicz

[11] Patent Number: 5,250,173

[45] Date of Patent: Oct. 5, 1993

[54] PROCESS FOR PRODUCING ANODIC FILMS EXHIBITING COLORED PATTERNS AND STRUCTURES INCORPORATING SUCH FILMS

[75] Inventor: Mark A. Jozefowicz, Kingston, Canada

[73] Assignee: Alcan International Limited, Montreal, Canada

[21] Appl. No.: 956,611

[22] Filed: Oct. 5, 1992

Related U.S. Application Data

[63] Continuation-in-part of Ser. No. 696,840, May 7, 1991, Pat. No. 5,167,793.

[51] Int. Cl.[5] ..... C25D 11/18

[52] U.S. Cl. ..... 205/121; 205/229

[58] Field of Search ..... 205/121, 229

[56] References Cited

U.S. PATENT DOCUMENTS

| | | | |
|---|---|---|---|
| 4,066,516 | 1/1978 | Sato | 204/15 |
| 4,066,816 | 1/1978 | Sheasby | 428/336 |
| 4,310,586 | 1/1982 | Sheasby | 428/220 |
| 4,921,823 | 5/1990 | Furneaux | 502/4 |

FOREIGN PATENT DOCUMENTS

| | | |
|---|---|---|
| 49-27449 | 3/1974 | Japan . |
| 59-5678 | 9/1982 | Japan . |

*Primary Examiner*—T. M. Tufariello
*Attorney, Agent, or Firm*—Cooper & Dunham

[57] ABSTRACT

A process for producing a structure including an anodic film exhibiting a colored pattern, and the resulting structures. The process involves anodizing a surface of a metal substrate or article made of or coated with aluminum or an anodizable aluminum alloy to produce an anodic film, preferably having pores extending from the film surface inwardly towards the underlying metal. A semi-reflective layer of a non-noble metal is then deposited within the pores of the film in order to generate a color by effects including light interference. Limited areas of the resulting film are then contacted with a solution of an acid or other leaching material, preferably by a maskless procedure, in order to leach the non-noble metal from the film, at least partially. The film is then contacted by a solution of a more noble metal compound (e.g. Pd, Au or Pt). The more noble metal from the solution at least partially replaces the non-noble metal remaining in or on the film and stabilizes the deposits against further leaching. A further anodization step creates different colors in the leached and unleached areas. The result is a patterned anodized article in which the colors are highly resistant to fading or lack of uniformity.

4 Claims, 3 Drawing Sheets

PROCESS FOR PRODUCING ANODIC FILMS EXHIBITING COLORED PATTERNS AND STRUCTURES INCORPORATING SUCH FILMS

CROSS-REFERENCE TO RELATED APPLICATION

This application is a continuation-in-part of our prior application Ser. No. 07/696,840 filed May 7, 1991, now U.S. Pat. No. 5,169,793.

TECHNICAL FIELD

This invention relates to the formation of anodic films having areas of discernably different colours, shades, hues or colour densities forming patterns, printing or other indicia (referred to hereinafter generally as coloured patterns) and to structures incorporating such films.

BACKGROUND ART

Anodizing is a well known surface treatment carried out on articles made of (or coated with) aluminum or anodizable aluminum alloys for the purpose of improving the decorative appeal of the articles and/or for improving surface durability. The procedure involves electrolysis carried out in an electrolyte containing a strong acid, such as sulphuric acid, phosphoric acid, oxalic acid or the like, using the aluminum article as an anode. As the electrolysis proceeds, an anodic film of aluminum oxide grows on the metal surface, with the thickness of the film increasing as the electrolysis continues. Competition between the growth of the anodic film and dissolution of the oxide by the acidic electrolyte creates a film having pores which extend from the external film surface inwardly towards the metal article. However, the innermost ends of the pores are always separated from the metal surface by a very thin barrier layer of dense imperforate anodic oxide. If a non-porous anodic film is desired, the anodization can be carried out in a less acidic electrolyte, but only very thin films can be produced in this way depending on the voltage used for the anodization procedure, so the formation of porous films is more usual.

Articles anodized in this way have surfaces which range from grey (i.e. the colour of the underlying metal, generally referred to hereinafter as "colourless" or "clear") to white in appearance depending on the thickness of the oxide film, but various procedures have been developed to colour the anodic films in order to improve the appeal of the articles to the eye. These range from the so-called ANOLOK (trademark of ALCAN ALUMINUM LTD) processes, which involve the electrolytic deposition of a metal (inorganic pigment) into the pores, to the use of dies or organic pigments to cause staining of the anodic film.

While these colouring procedures have been applied successfully for many purposes, they suffer from certain disadvantages. For example, articles coloured by the ANOLOK procedures (as disclosed in our prior U.S. Pat. Nos. 4,066,816 of Jan. 3, 1978 and 4,310,586 of Jan. 12, 1982, both to Sheasby et. al.) may exhibit lack of colour uniformity and the procedure may be difficult to control. Articles coloured by organic pigments and the like exhibit fading when exposed to UV light, and have therefore not been used extensively in exterior (e.g. architectural or automotive) applications.

Moreover, when it is desired to produce coloured patterns on the surfaces of anodized articles, resort has generally been made to the use of adhering masks and the like to cover certain areas of the surface while other areas are subjected to a colouring treatment. The masks then have to be removed and, if desired, further areas masked so that the uncoloured areas can themselves be coloured. This is not only a complex and expensive procedure, it also requires the use of masking materials and solvents that may cause environmental problems when disposed of.

In our prior European patent application Ser. No. 90303069.0 filed on Mar. 22, 1990 and published under Publication No. 0 389 274 A2 on Sep. 26, 1990, a method is described of producing optical interference structures incorporating porous anodic films in which interference colours are generated by the inclusion of semi-reflective layers into the films by electrodeposition and the like. It is disclosed that the deposits may be made more resistant to leaching by replacing the deposited metal with a more noble metal which is much more resistant to corrosion. However, the method is used only for producing films of uniform colour throughout, rather than patterned films. If patterns are required, masking techniques must again be employed.

It is therefore an object of the invention to provide a process which can result in the production of patterned anodic films which are less susceptible to colour loss (fading) or loss of colour uniformity, while providing a good range of colours.

It is also an object, at least of preferred forms of the invention, to provide a process which can produce coloured patterns on anodized surfaces without resort to the use of masks temporarily adhered to the anodized surfaces.

Yet another object of the invention is to provide a process for producing coloured patterns on an anodized surface by a procedure which generates colours at least partially by interference effects.

DISCLOSURE OF THE INVENTION

According to one aspect of the present invention there is provided a process of producing a structure incorporating an anodic film exhibiting a coloured pattern, which process comprises: anodizing a surface of a substrate made of or coated with an anodizable metal selected from the group consisting of aluminum and anodizable aluminum alloys, to produce an anodic film formed on an underlying metal surface; depositing a semi-reflective layer of a non-noble metal within said film such that reflections from said semi-reflective layer contribute to the generation of a visible colour by effects including light interference; contacting limited areas of said film with a solution capable of at least partially leaching said metal from said film; and contacting the surface of said film with a solution of a more noble metal compound in order to at least partially replace non-noble metal remaining in said film by said more noble metal.

According to another aspect of the invention there is provided a structure incorporating a patterned anodic film, said structure comprising: a metal substrate; an anodic film overlying said substrate; and a semi-reflective layer within said film comprising deposits containing a more noble metal produced by contacting initial deposits of a non-noble metal with a solution of a more noble metal salt, said semi-reflective layer contributing to the generation of a visible colour by effects including light interference; said film including at least two different areas exhibiting different colours, the deposits in at least one of said areas differing from the deposits in at least one other of said areas in having had said initial non-noble deposits subjected to a preliminary partial leaching step before said contact with said solution of said more noble metal salt.

According to yet another aspect of the invention, there is provided a thin flexible membrane having a coloured pattern, comprising: a thin flexible metal substrate; an anodic film overlying said substrate; a semi-reflective layer within said film comprising deposits containing a more noble metal produced by contacting initial deposits of a non-noble metal with a solution of a more noble metal salt, said semi-reflective layer contributing to generation of a visible colour by effects including light interference; said film including at least two different areas exhibiting different colours, the deposits in at least one of said areas differing from the deposits in at least one other of said areas in having had said initial non-noble deposits subjected to a preliminary partial leaching step before said contact with said solution of said more noble metal salt; and a layer of transparent flexible material overlying and supporting said anodic film.

It should be appreciated that, throughout this disclosure and the accompanying claims, when reference is made to different colours, it is intended that this expression should include any discernable differences whatsoever of the coloured areas, including differences of colour shade, hue or saturation of a single colour as well as distinctly different colours or hues. It should also be appreciated that the term "pattern" or any derivative thereof is intended to include any abstract, irregular or regular pattern, printing, marking, indicia or any other shape or arrangement of areas of the anodic film having different appearance.

Furthermore, by the expression "maskless techniques" I mean techniques of applying the solution of the leachant to the anodic film which avoid the prior application of adhering masks to the anodic film. Examples of such maskless techniques include flexographic printing of the noble metal solution onto the anodic film, rubber stamping, spraying coarse droplets, pulsed spraying to form random dot or streak patterns, application by pen, paint brush or sponge, spraying through a stencil, silk screening, etc.

By the terms "non-noble metal" as used herein I mean a metal which is quite readily leached by an acid or oxidant solution. By the term "more noble metal", I mean a metal which is more noble according to the electrochemical series and also substantially resistant to leaching.

BRIEF DESCRIPTION OF THE DRAWINGS

Like elements are identified by like reference numerals throughout the various figures.

It should be noted that the various elements of any particular article are not drawn to scale.

BEST MODES FOR CARRYING OUT THE INVENTION

Figure 1A:
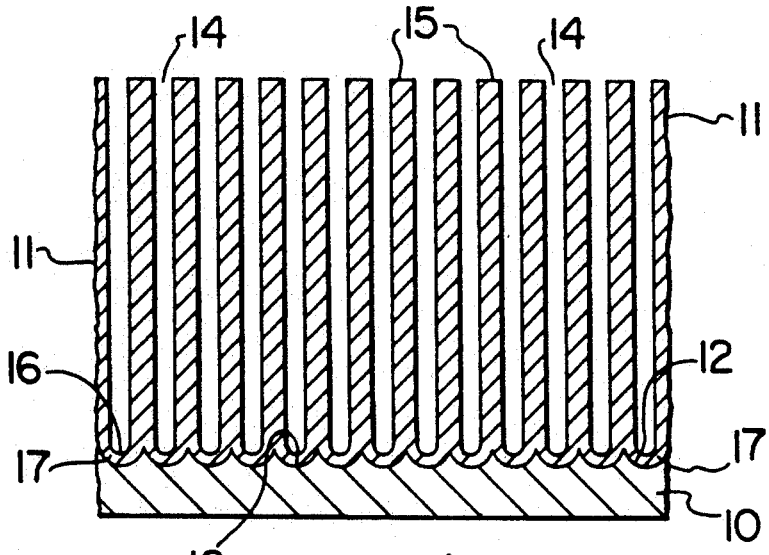
FIGS. 1(A) to (F) show cross-sections of an aluminum article at the surface region thereof after various steps in a preferred basic process according to the present invention.

FIGS. 1(A)-1(F) show the steps of a basic preferred process according to the invention. FIG. 1(A) shows an article 10 having a porous anodic film 11 on an outer surface 12 thereof. The article may be, for example, a thin flexible foil, a laminate, a plate, a sheet, an extrusion, a casting, a shaped element or any other article of manufacture of the kind normally subjected to anodization either for decorative reasons or for surface protection.

The article 10 is made of, or coated with, aluminum or an anodizable aluminum alloy and the porous anodic film 11 can be formed in the conventional manner, e.g. by immersing the surface 12 in an electrolyte containing an inorganic acid, such as sulphuric acid, phosphoric acid or chromic acid, or an organic acid such as oxalic acid, or a mixture of such acids, providing an electrode in contact with the electrolyte and applying a voltage between the electrode and the article. The voltage may be AC, DC, AC/DC, high voltage, low voltage, ramped voltage, etc. and is normally in the range of 5-110 V. However, the final stage of the anodization should preferably be carried out in such a way that inner ends 16 of the pores 14 remain separated from the metal article 10 by a thin barrier layer 17 of imperforate anodic oxide of suitable thickness to permit subsequent electrolytic deposition of a metal in the pores 14. The barrier layer 17 should consequently have a thickness in the range of 20-500 Å, and more preferably 50-200 Å. This can be achieved by carrying out at least the last few seconds of the anodization, with the article 10 forming the anode, at a voltage of between 2-50 volts, preferably 5-20 volts.

Figure 1B:
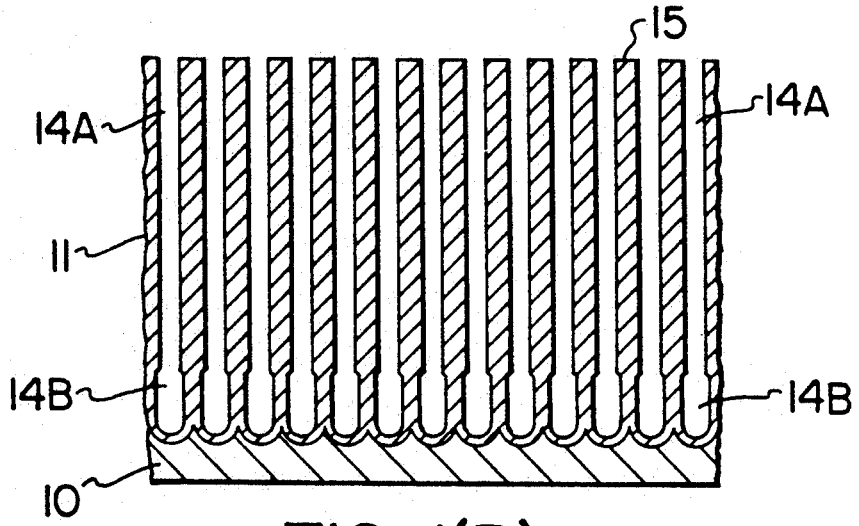

While the pores 14 may be of uniform thickness throughout their length as shown in FIG. 1(A), it is more preferable to produce pores having narrow outer portions 14A and wider inner portions 14B as shown in FIG. 1(B). This is because metal deposits formed in the wider portions 14B have larger outer surfaces than would be the case if the pores were uniformly narrow, and the larger outer surface areas lead to stronger reflections from the surfaces and thus to enhanced interference effects and stronger generated colours. So-called "bottle neck" pores of this kind can be produced by changing the acid of the electrolyte part of the way through the electrolysis procedure from a less corrosive acid (e.g. sulphuric acid) to a more corrosive acid (e.g. phosphoric acid). For more details of this procedure, see our U.S. Pat. No. 4,066,816 to Sheasby et al, the disclosure of which is incorporated herein by reference.

The film 11 can be made to have virtually any desired thickness by carrying out the electrolysis for an appropriate length of time. For decorative interior applications, the film 11 may be just few thousandths of a millimeter (microns) thick, but for architectural or automative applications, the film may be up to $25\times10^{-4}$ cm (25 microns) or more in thickness.

Figure 1C:
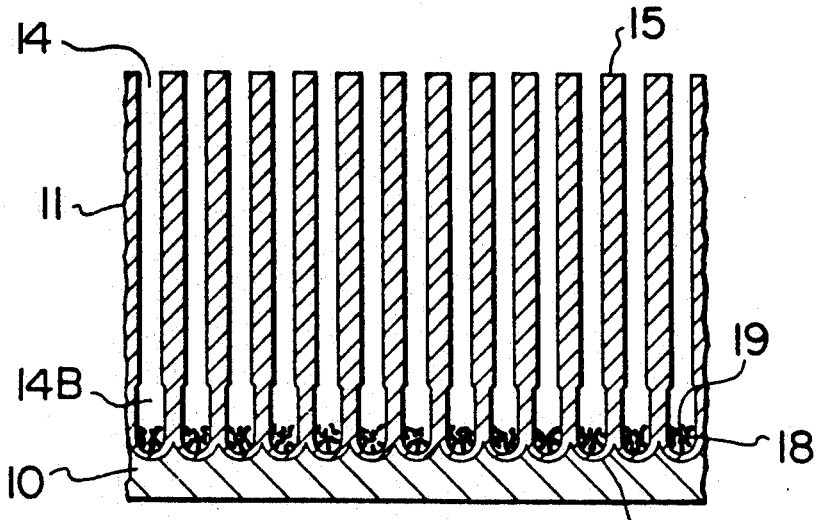

Deposits 18 as shown in FIG. 1(C) of a non-noble metal are then introduced into the pores 14 at their wide inner ends 14B by an electrodeposition technique. This can be achieved, for instance, by the so-called ANOLOK (trademark) procedure described in our U.S. Pat. No. 4,066,816 mentioned above (the disclosure of which is incorporated herein by reference). For example, the anodized surface may be immersed in an acidic solution of an appropriate metal salt (e.g. a salt of nickel, cobalt, tin, copper, silver, cadmium, iron, lead, manganese or molybdenum, or an alloy such as Sn-Ni and Cu-Ni) as an electrolyte, a counter electrode (made for example of graphite or stainless steel, or nickel, tin or copper when the electrolyte contains a salt of the corresponding metal) positioned in contact with the solution, and an alternating voltage applied between the article and the counter electrode.

As will be seen from FIG. 1(C), the electrodeposition procedure is not usually continued long enough to completely fill the pores 14 but only until outer ends 19 of the deposits 18 collectively form a semi-reflective surface which is separated from the underlying metal surface 12 (the oxide/metal interface) by a distance in the order of 500–3000 Å ($0.05-0.3\times10^{-3}$ mm). Optical interference can then take place between light reflected from the surfaces 19 of the deposits 18 and the surface 12 of the underlying metal. This results in the production of an interference colour whose appearance depends largely on the difference in optical path of the light reflected from the two surfaces but also partly on the light absorption properties of the deposits 18.

Since the present invention relies on the generation of colour to a large extent by interference effects, only small amounts of the metal need be deposited, so short term and/or low voltage deposition is generally used. The result is a range of attractive colours, including blue-grey yellow-green, orange and purple, depending on the identity of the electrodeposited metal and the height of the deposits.

Figure 1D:
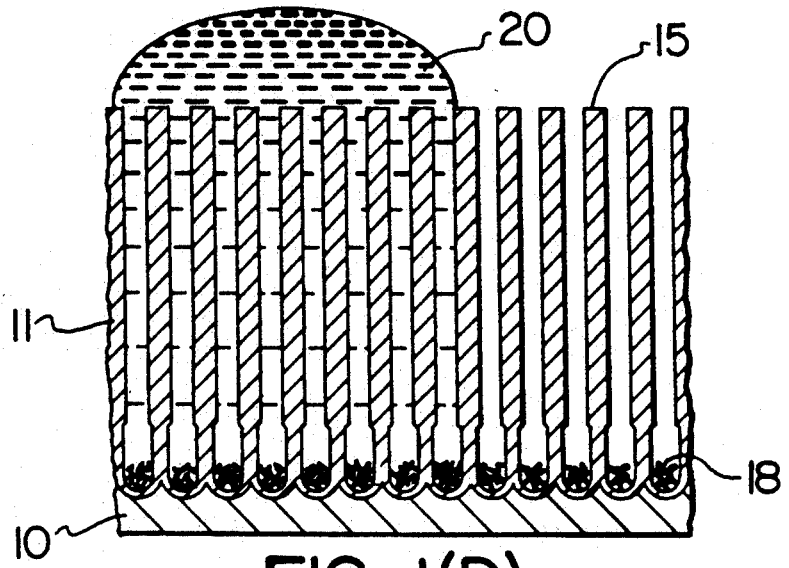

As shown in FIG. 1(D), following the introduction of deposits 18 into the pores, limited areas of the surface 15 of the anodic film 11 are contacted with a solution 20 capable of partially or completely leaching the non-noble metal deposits 18 from the anodic film 11. Acidic aqueous solutions may be used as the leaching solution, e.g. nitric or sulphuric acid solutions. The degree of leaching achieved using such acidic solutions depends on the identity of the acid and on its concentration. In the case of nitric acid, 50 vol % solutions result in substantially complete leaching, whereas 5 vol % solutions result in partial leaching. In the case of sulphuric acid, 165 g/L solutions, for example, produce partial leaching. Other acids, oxidants, etc. can be used provided the anodic oxide film is not thereby damaged beyond usefulness.

Figure 1E:
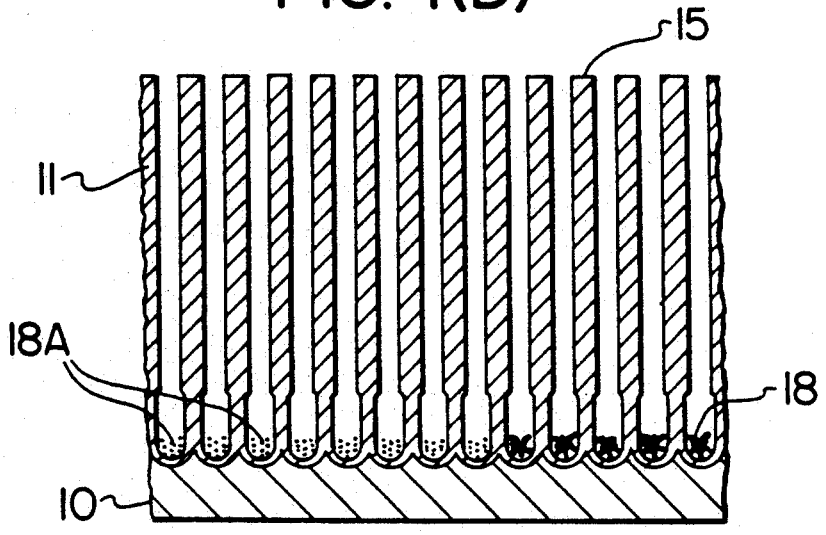

As shown in FIG. 1(E), the deposits 18A contacted by the leaching solution 20 are only partially leached from the film if the solution 20 is of moderate acidity and an unleached part of the metal deposit remains in such cases, probably as a mass of much the same size as the original deposit, but of greater porosity. This difference makes the areas contacted by the solution 20 appear different in colour saturation from the uncontacted areas, probably because of different absorption or scattering effects upon incident light in the treated and untreated areas. As a result, a usually visible pattern is created by the areas of contrasting colour saturation of the same general hue.

Of course, if the solution 20 is of sufficient acid strength or concentration, the deposits 18 will be completely leached from the film 11 in those limited areas where the solution 20 contacts the film, so the film will then have coloured (unleached areas) and uncoloured (fully leached) areas which together form a pattern.

Since very little of the solution 20 is required, the solution can be applied without the need for prior application of an adhering mask to the surface 15, although a non-adhering mask, such as a stencil or silk screen, may be used to limit the areas of contact between the surface 15 and the solution 20 applied, for example, by spraying, brushing or wiping. Even such a non-adhering mask may not be required, however, if the solution is applied by a technique which restricts the area of application, e.g. flexographic printing, ink jet printing, rubber stamping, spraying, splashing, painting, flowing, wiping, rolling, coarse spraying (to form separated droplets on the surface 15) or, most preferably, pulsed spraying from a short distance (e.g. 30 cm). The solution 20 is usually applied in such small quantities that drying may take place very rapidly, so smearing of the intended pattern can be avoided, if desired, although smearing may be intended in some cases for decorative effect.

Once the leaching solution 20, or any rinsing solution applied to the surface after the leaching solution, has dried partially or completely, essentially the entire surface 15 of the film is contacted with a solution of a material which stabilizes the non-noble metal against further leaching. This stabilizing material is generally a more noble metal such as platinum, palladium or gold, the preferred material being palladium, usually in solution in concentrations ranging from 0.05 to 100 g/L, preferably 0.2 to 10 g/L. Unleached deposits 18 and partially leached deposits 18A in the pores 14 act as seeds for deposition of the more noble metal from the stabilizing solution and are at least partially replaced by the more noble metal. This stabilizes the deposits against further leaching.

The article bearing the resulting pattern of contrasting colour densities can be used if desired without further treatment. It is however highly desirable to produce structures having a greater range of colour contrast by carrying out a further anodization step on the structure of FIG. 1(E) in order to produce a structure of the type shown in FIG. 1(F). The electrolyte used for this further anodization step, which may be the same as one of those mentioned above for the initial anodization step, does not leach the more noble metal deposits 18 and 18A out of the pores 14 to any substantial extent because of the stability of these deposits to the acid electrolyte. However, the additional anodization step thickens the film 11 and increases the separation of the deposits 18 and 18A from the underlying metal surface 12. This changes the interference effects generated by reflections from the semi-reflective surface formed by the deposits and the underlying surface 12 and thus changes the observed colours.

Figure 1F:
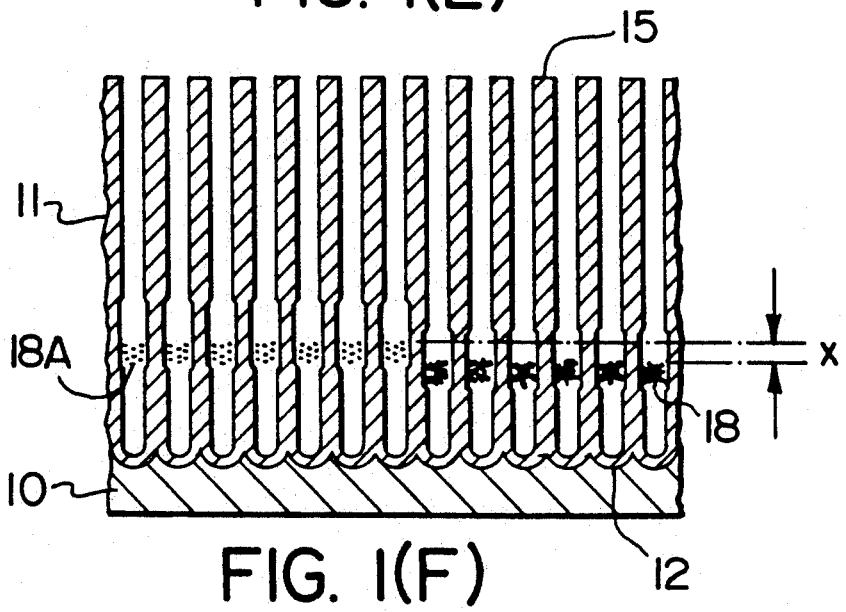

Surprisingly, the additional anodization step significantly increases the difference in observed colour between the unleached and partially leached areas instead of just maintaining a difference of saturation of the same hue. The result is often a distinct difference in hues or colours. Without wishing to be bound by a particular theory, it is currently speculated that this may be because the thickness of thepart of the film 11 formed beneath the partially leached deposits 18A may be greater than the thickness beneath the unleached deposits 18, as shown in FIG. 1(F). This may be because the deposits 18 and 18A act to impede the additional anodization step and hence the thickening of the layer beneath the deposits. However, the partially leached deposits 18A, being more porous or less massive, provide less of an impediment to the anodization and allow these areas to anodize faster or at least get a "head start" on the anodization taking place beneath the unleached deposits 18. The difference in vertical level of the upper surfaces of the deposits in the different regions of the film, represented by the distance x, results in the generation of different interference effects. Since the thickness of the film 11 beneath the deposits 18 and 18A affects the interference of light reflected from the deposits and the underlying metal layer 12, the colours generated in the partially leached and unleached areas show a greater degree of difference than the structure of FIG. 1(E) and the colour contrast is significantly enhanced.

For such interference colours to be produced, the additional layer of film 11 grown beneath the deposits should preferably be kept below $1\times10^{-4}$ cm (1 micron), preferably $0.05\text{–}0.75\times10^{-4}$ cm (0.05–0.75 microns). The colours which can be obtained in this way are clear blues, reds, greens, purples, oranges, etc. free of "muddiness" or bronze colours often associated with electrodeposited metals.

Incidentally, in the additional anodization step, the voltage must be sufficient to overcome the electrical resistance imposed by both the existing barrier layer 17 and metal deposits 18, 18A. In general, the voltage should be equal to or greater than the final voltage used for the formation of the structure of FIG. 1(A).

After this further anodization step, the normal pore-sealing steps usually carried out after anodizing treatments, e.g. immersion in near-boiling water at or about neutral pH, can be employed and/or the surface 15 may be covered by a protective polymeric transparent film.

The deposits 18 and 18A contain or consist of a more noble metal than the metal initially deposited and are consequently quite stable and do not undergo fading or loss of colour uniformity.

Variations of the eventual decorative effect can be produced by slight modifications of the procedure. These modifications include: spraying on a dried surface and allowing the droplets to dry before proceeding, which results in well defined areas of different colour; spraying on a moistened (pre-sprayed) surface, which can result in a streaky effect reminiscent of wood grain; spraying different leaching solutions containing different acids or acid concentrations over different areas of the surface to produce different degrees of leaching (possibly including complete leaching) in different areas and thus interesting multi-coloured effects; post-spray rinsing before or after drying of the leaching solution on the surface; etc. Moreover, adjustments to physical properties of the leaching solution, such as viscosity, surface tension and the like, may produce variations in the patterns eventually produced.

The additional anodization may also be modified to affect the pattern produced, for example by controlling the power to maximize the "head start" that the film beneath the partially leached deposits gets compared to the film beneath the unleached deposits.

If desired, even further visual effects can be imparted to the patterned articles produced by the basic procedure described above by carrying out a pretreatment of the surface of the metal article 10. For example, caustic etching may be employed to impart a satin finish, mechanical or chemical polishing may be used to create a bright finish, or sandblasting can be carried out for a dull finish, etc.

Depending on film thicknesses and the like, the patterns produced by the present invention are sometimes dichroic or optically variable (i.e. they exhibit different colours at different viewing angles). This is very useful for certain applications, e.g. security applications, because such effects cannot be reproduced by colour photocopiers and the like.

This method of patterning is amendable to thin and thick films and is well suited to both continuous and batch processing.

The procedures described above have all been concerned with the production of a patterned anodized surface on an article (substrate) made of or coated with aluminum or an aluminum alloy. The process of the invention can, however, be used to form a patterned anodic film structure detached from the aluminum-containing article on which it was formed. The present invention includes the formation of such detached patterned films which can be produced in the manner indicated below.

Figure 2A:
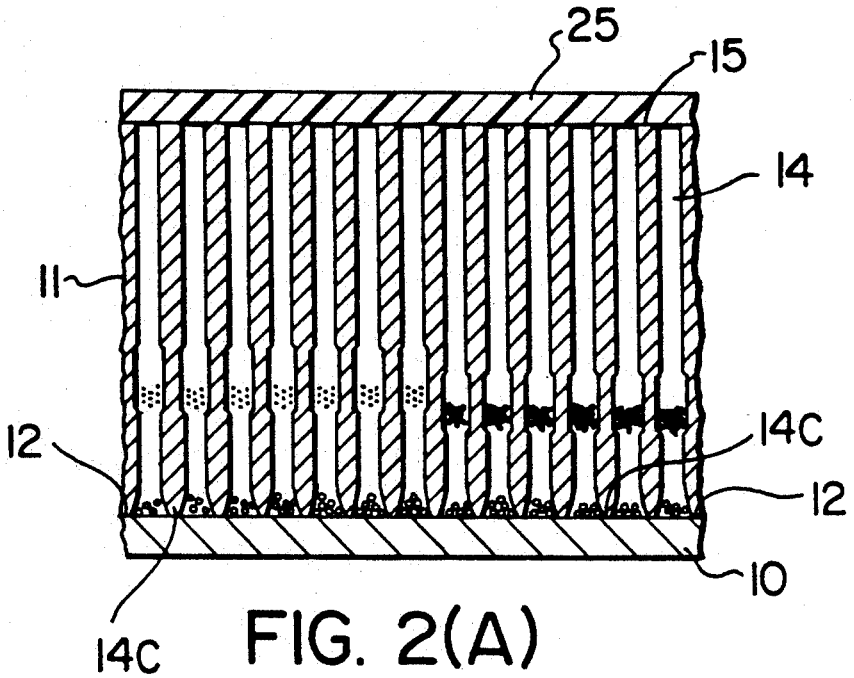
FIGS. 2(A) and 2(B) are cross-sections showing steps in the formation of a flexible patterned film according to a further preferred embodiment of the present invention.

The structures of FIG. 1(F) may be made to undergo a final anodization step, either as part of the last anodization step of the formation process or as a separate final step, that involves a voltage reduction procedure which introduces a weakened stratum into the structure at the metal/oxide interface 12. Voltage reduction procedures of this kind are disclosed in our European patent application no. 0,178,831 published on Apr. 23, 1986, the disclosure of which is incorporated herein by reference. The starting voltage should be higher than or equal to the highest anodizing voltage used previously and the voltage is then reduced either continuously or stepwise until it approximates zero. The film is allowed periods of soaking in the acidic electrolyte between the voltage reduction steps or as the reduction proceeds. This results in a pore branching phenomenon at the inner ends of the pores 14 as shown in FIG. 2(A). The pores 14 divide into numerous narrow channels 14C adjacent to the underlying metal surface 12 which reduces the thickness of the barrier layer 17 (see FIG. 1(A)) and makes the film 11 very easy to detach from the metal article 10.

Figure 2B:
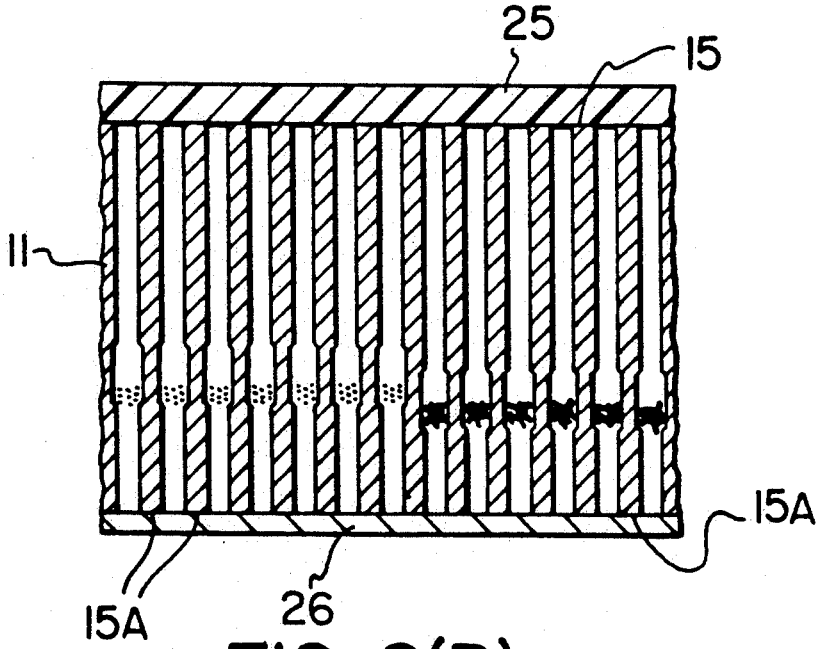

A flexible transparent overlayer 25 may then be attached to the anodic film 11, e.g. a polymer film (such as polyester) applied by heat sealing or by means of an adhesive, and the flexible overlayer 25 may then be used to detach the film 11 from the metal article 10 by pulling or peeling. Once the film has been detached from the article 10, a reflective metal layer 26 may be applied to the newly exposed film surface 15A, e.g. by sputtering or other vacuum deposition technique, in order to provide the necessary reflections for light interference and hence colour generation. The metal used for this layer need not be an aluminum-containing metal and need only be a fraction of a micron in thickness, but could be thicker if desired for greater durability. The resulting structure, as shown in FIG. 2(B), may be used for example as a patterned packaging film.

The present invention is illustrated in more detail by the following non-limiting Examples.

EXAMPLE 1

An anodized aluminum panel having the structure shown in FIG. 1(B) was dried and pulse sprayed with a 165 g/L $H_2SO_4$ solution so that discrete droplets were formed in a random pattern over the surface. The droplets were allowed to dry, and then the panel was immersed in a 350 ppm Pd (as $PdSO_4$) solution at pH 1.7 for a period of 2 minutes in order to stabilize the deposits. After thorough rinsing, the panel was transferred to the original $H_2SO_4$ anodizing solution and pulse reanodized at 65 $A/m^2$ for varying durations, as indicated in the following:

| TIME (s) | PATTERN | BACKGROUND |
|---|---|---|
| 30 | medium bronze | light bronze |
| 60 | light blue | light purple/grey |
| 90 | light green | light blue |
| 120 | light orange | light yellow/green |
| 150 | medium purple | light orange |
| 180 | medium blue | medium purple |
| 210 | neon green | light blue |
| 240 | yellow | light green |

EXAMPLE 2

A dried anodized panel as used in Example 1 was pulse sprayed with a 165 g/L $H_2SO_4$ solution so that the discrete droplets initially formed streaked (by gravity) down in a random pattern over the surface. The panel was allowed to dry and then immersed in a 350 ppm Pd (as $PdSO_4$) solution at pH 1.7 for a period of 2 minutes. After thoroughly rinsing, the panel was transferred to the original $H_2SO_4$ anodizing solution and pulse reanodized at 65 A/m$^2$ until 140 coulombs/m$^2$ has passed. The anodic film was then hot water sealed.

The result was light blue streaks on a medium blue background.

EXAMPLE 3

A dried anodized panel as used in Example 1 was pulse sprayed with a 165 g/L $H_2SO_4$ solution so that discrete droplets formed a pattern over the surface. While still wet, the panel was thoroughly rinsed, and then immersed in a 350 ppm Pd (as $PdSO_4$) solution at pH 1.7 for a period of 2 minutes. After thorough rinsing, the panel was transferred to the original $H_2SO_4$ anodizing solution and pulse reanodized at 65 A/m$^2$ until approximately 30 coulombs/m$^2$ had passed. The anodic film was then hot water sealed.

The result was a random spotted pattern where the spots had medium purple extremities and lighter central regions. The background colour was light pink.

EXAMPLE 4

A dried anodized panel of the type used in Example 1 was pulse sprayed with a 50% vol. $HNO_3$ solution so that discrete droplets formed a pattern over the surface. After drying and rinsing, the panel was immersed in a 350 ppm Pd (as $PdSO_4$) solution at pH 1.7 for a period of 2 minutes. After thoroughly rinsing, the panel was transferred to the original $H_2SO_4$ anodizing solution and pulse reanodized at 20 V for 270 seconds. The anodic film was then hot water sealed.

The result was a random spotted pattern in which the spots were uncoloured and the background was medium/dark violet.

EXAMPLE 5

A dried anodized panel as used in Example 1 was pulse sprayed with a 50% vol. $HNO_3$ solution, allowed to dry, and then sprayed with a 165 g/L $H_2SO_4$ solution so that in both cases discrete droplets formed a pattern over the surface. After drying and rinsing, the panel was immersed in a 350 ppm Pd (as $PdSO_4$) solution at pH 1.7 for a period of 2 minutes. After thoroughly rinsing, the panel was transferred to the original $H_2SO_4$ anodizing solution and pulse reanodized at 20 V for 270 seconds. The anodic film was then hot water sealed.

The result was a random spotted pattern in which some spots (those that were a result of the less corrosive $H_2SO_4$) were blue and others were uncoloured. The background was medium/dark violet.

What I claim is:

1. A process of producing a structure incorporating an anodic film exhibiting a colored pattern, which process comprises:

anodizing a surface of a substrate made of or coated with an anodizable metal selected from the group consisting of aluminum and anodizable aluminum alloys, to produce an anodic film formed on an underlying metal surface;

depositing a semi-reflective layer of a non-noble metal within said film such that reflections from said semi-reflective layer contribute to the generation of a visible color by effects including light interference;

contacting limited areas of said film with a solution capable of at least partially leaching said metal from said film; and contacting the surface of said film with a solution of a more noble metal compound in order to at least partially replace non-noble metal remaining in said film by said more noble metal.

2. A process according to claim 1 wherein, after contacting said surface with said solution of a more noble metal compound, said substrate is subjected to further anodization to thicken a portion of said film beneath said semi-reflective layer.

3. A structure incorporating a patterned anodic film, said structure comprising:

a metal substrate;

an anodic film overlying said substrate; and a semi-reflective layer within said film comprising deposits containing a more noble metal produced by contacting initial deposits of a non-noble metal with a solution of a more noble metal salt, said semi-reflective layer contributing to generation of a visible colour by effects including light interference;

said film including at least two different areas exhibiting different colours, the deposits in at least one of said areas differing from the deposits in at least one other of said areas in having had said initial non-noble deposits subjected to a preliminary partial leaching step before said contact with said solution of said more noble metal salt.

4. A thin flexible membrane having a coloured pattern, comprising:

a thin flexible metal substrate;

an anodic film overlying said substrate;

a semi-reflective layer within said film comprising deposits containing a more noble metal produced by contacting initial deposits of a non-noble metal with a solution of a more noble metal salt, said semi-reflective layer contributing to generation of a visible colour by effects including light interference;

said film including at least two different areas exhibiting different colours, the deposits in at least one of said areas differing from the deposits in at least one other of said areas in having had said initial non-noble deposits subjected to a preliminary partial leaching step before said contact with said solution of said more noble metal salt; and a layer of transparent flexible material overlying and supporting said anodic film.

* * * * *